US007275270B2

(12) United States Patent
Cotutsca

(10) Patent No.: US 7,275,270 B2
(45) Date of Patent: Oct. 2, 2007

(54) UTILITY HOLDER FOR HEADWEAR

(75) Inventor: Peter Cotutsca, Tesuque, NM (US)

(73) Assignee: Broadmark, Inc., Los Angeles, CA (US)

( * ) Notice: Subject to any disclaimer, the term of this patent is extended or adjusted under 35 U.S.C. 154(b) by 0 days.

(21) Appl. No.: 10/570,078

(22) PCT Filed: Mar. 2, 2005

(86) PCT No.: PCT/US2005/006981

§ 371 (c)(1),
(2), (4) Date: Feb. 28, 2006

(87) PCT Pub. No.: WO2005/084472

PCT Pub. Date: Sep. 15, 2005

(65) Prior Publication Data

US 2007/0028360 A1 Feb. 8, 2007

(51) Int. Cl.
*A42B 1/24* (2006.01)

(52) U.S. Cl. ..... 2/209.13; 351/155

(58) Field of Classification Search ..... 2/209.13; 351/155; 24/3.1

See application file for complete search history.

(56) References Cited

U.S. PATENT DOCUMENTS 2,744,256 A * 5/1956 Slotkin et al. ..... 2/209.13
4,179,753 A 12/1979 Aronberg et al.
5,034,862 A * 7/1991 Liston ..... 362/105
5,053,932 A 10/1991 Case
5,253,368 A * 10/1993 Blake ..... 2/209.13
5,829,103 A 11/1998 Allen
5,860,167 A 1/1999 Lizio
5,867,874 A 2/1999 Simpson
5,894,604 A * 4/1999 Crabb et al. ..... 2/209.13
5,933,871 A 8/1999 Kraft
6,115,843 A * 9/2000 Travalgia ..... 2/171
6,185,748 B1 2/2001 DeChambeau
6,210,003 B1 4/2001 Chan
6,237,159 B1 5/2001 Martin
6,247,177 B1 * 6/2001 Hayes ..... 2/12
6,298,495 B1 * 10/2001 Totani ..... 2/209.13
6,442,764 B1 * 9/2002 Badillo et al. ..... 2/209.13
6,481,059 B2 * 11/2002 Morris ..... 24/3.12
6,644,807 B1 11/2003 Hood
6,647,554 B1 * 11/2003 Yan ..... 2/209.13
6,668,426 B1 12/2003 Morris
6,671,885 B2 * 1/2004 Viggiano ..... 2/209.13

(Continued)

FOREIGN PATENT DOCUMENTS

JP 03087717 A 4/1991

*Primary Examiner*—Katherine Moran
(74) *Attorney, Agent, or Firm*—Blakely, Sokoloff, Taylor & Zafman LLP

(57) ABSTRACT

A utility holder assembly for securely holding articles such as eyewear and the like, small tools and accessories such as screwdrivers, flash lights, pliers, and the like, and writing utensils such as pencils, pens and the like to the sides of various types and styles of headwear. The utility holder assembly may be mounted on the outside surface or the inside surface of the headwear to accommodate easy insertion of an article for temporary storage. The holder may include a gripping mechanism such as hook and loop fasteners, a ductile layer, or a ductile member, such that the holder may be configured to conform to the shape of the article to more securely retain the article within the holder.

17 Claims, 17 Drawing Sheets

U.S. PATENT DOCUMENTS 6,719,437 B2 4/2004 Lary et al.
6,792,619 B1 * 9/2004 Morris et al. ..... 2/10
7,003,809 B1 * 2/2006 Gordon ..... 2/209.13
2002/0023287 A1 2/2002 Badillo et al.
2002/0069488 A1 6/2002 Morris
2003/0024033 A1 2/2003 Viggiano

* cited by examiner

A - A

A - A

B - B

B - B

UTILITY HOLDER FOR HEADWEAR

BACKGROUND

1. The Field of the Invention

The present disclosure relates generally to headwear, and more particularly, but not necessarily entirely, to an apparatus for holding a variety of articles including eyewear, writing utensils and other small tools and accessories on a user's headwear.

2. Description of Related Art

It is common practice for individuals to wear sunglasses or other types of eyewear, particularly in the outdoors, to protect the individual's eyes against the harmful rays of the sun. It is also common practice for individuals to further utilize headwear, such as hats, caps, visors or headbands, for example, to provide further protection against the sun or to keep sweat out of the individual's face. It often becomes desirable to remove eyewear, such as sunglasses for example, when entering a darkened environment. Moreover, it is common practice to utilize articles such as pencils, flashlights or tools such that it often becomes beneficial to provide a holding device for holding the eyewear or articles when they are not in use.

Holding devices are known in the art for holding articles, such as glasses, on headwear. However, the known holding devices may be limited by cumbersome designs which may not be very practical, economic or even visually appealing. Other known holding devices may not allow the articles to be securely held to the headwear or may be difficult to operate. Although the prior holding devices have been useful for their intended purpose, the implementation and ease of operation of the devices remains inflexible, rigid and costly.

Accordingly, a need has existed to provide a more versatile and flexible mechanism to conveniently hold a wide variety of different types, shapes and sizes of articles including eyewear, writing utensils and other small tools, on various types and styles of headwear. Such a holding mechanism is disclosed in the present utility holder for headwear described herein. The present disclosure provides an improvement over prior art devices due to lower manufacturing costs and simpler design implementation with improved safety features and attaching capabilities.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

SUMMARY

The present disclosure describes a uniquely superior and convenient storage mechanism for articles such as eyeglasses, sunglasses, safety glasses, prescription glasses and the like, writing utensils such as pens, pencils and the like, and small tools such as screw drivers, pliers, laser pointers, small flash lights and the like, on a great variety of headwear.

Accordingly, one illustrative embodiment of the present disclosure may include a pair of utility holders positioned on the left and the right sides of headwear to receive the above described articles in a sliding manner. The utility holder material may be comprised of textile and/or flexible and/or elastic materials to accommodate the various sizes and shapes of the above described articles in a secure manner. The utility holder assembly may be permanently or removably sewn, attached, adhered or otherwise mounted to the exterior and/or the interior surface of the headwear.

The holder may include a top lateral edge or support and a bottom lateral edge or support, and the holder may have an open ended front edge and rear edge such that the holder may be capable of slideably receiving an article. The utility holder may be shaped and dimensioned, for slideably receiving a rear most portion of an article so that the rear most portion of the article, depending on the depth dimension of the article, may or may not project outwardly beyond the rear edge and/or the front edge of the utility holder, and therefore at least a portion of the article may be held securely within the utility holder.

In addition, the utility holder may also be mounted on the inside surface of the headwear to achieve a more integrated and unobtrusive design. The utility holder may also be mounted on an elastic head band type assembly which can be placed interchangeably on conventional headwear and therefore accommodate many sizes and styles of headwear.

Various different types of gripping mechanisms may be utilized with the holder so as to more securely retain the articles within the holder. It will be appreciated that the gripping mechanisms provided within the scope of the present invention provide advantages not hitherto available.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
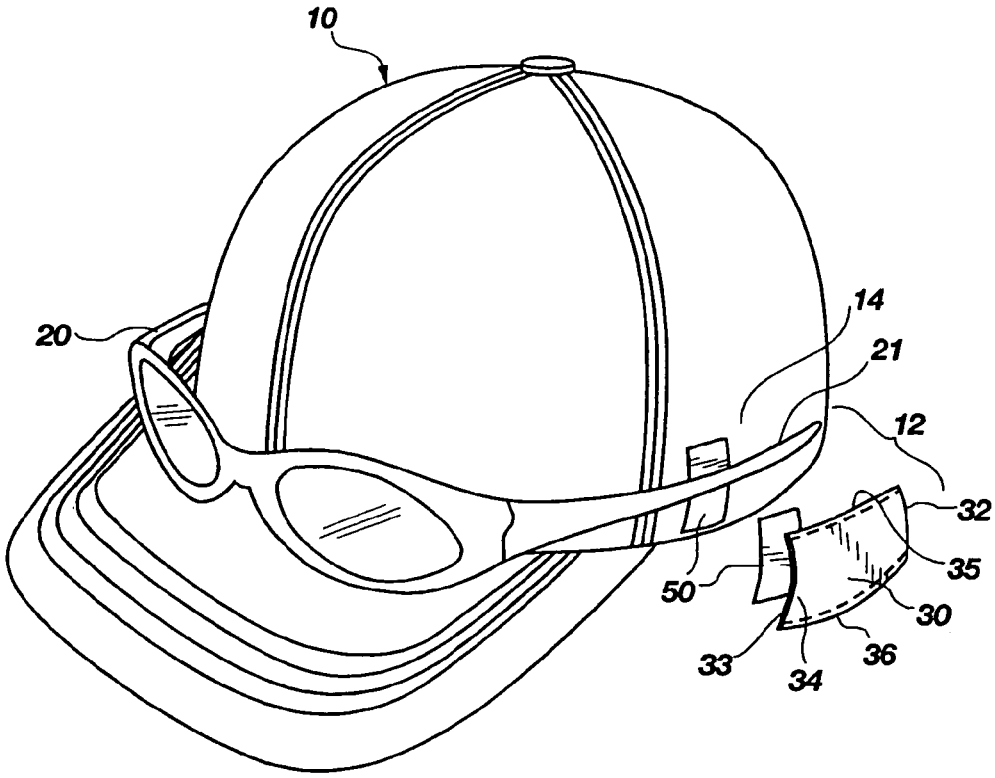
FIG. 1 is a perspective, three-dimensional exploded view of one embodiment of an externally mounted utility holder with an article inserted according to one embodiment of the disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise. Moreover, as used herein, the terms "comprising," "including," "containing," "characterized by," and grammatical equivalents thereof are inclusive or open-ended terms that do not exclude additional, unrecited elements or method steps.

As referred to herein the term "ductile" shall be construed broadly to include a property in which an item has the capability of being molded or shaped by a human hand into different configurations by a typical user of the disclosed embodiments without the assistance of tools or machines, and wherein the item substantially maintains the molded shape unless acted upon by another molding force. Exemplary materials which can be utilized in accordance with the teachings of the present disclosure can be obtained from the publications: Callister, William D., *Materials Science and Engineering: An Introduction*, 4$^{th}$ Ed. (1997) (John Wiley & Sons, New York); and, Brady, George S., Clauser, Henry R. and Vaccari, John A., *Materials Handbook: An Encyclopedia for Managers, Technical Professionals, Purchasing and Production Managers, Technicians, and Supervisors*, 14th Ed. (1997) (McGraw-Hill, New York), which are now incorporated herein in their entireties.

Referring now to FIG. 1, a perspective view of one illustrative embodiment of the present disclosure is shown, including a headwear member, indicated generally at 10. As used herein, the terms headwear, or headwear member, shall be construed broadly to include various articles of apparel known in the art that may be worn on a user's head, such as hats of various styles, including caps and visors, as well as head bands, for example. It is typical that the user will be human but it will be appreciated that it is also within the scope of the present disclosure to accommodate other anatomy and structures which fall within the scope of the term "head" but which are other than human.

Figure 3:
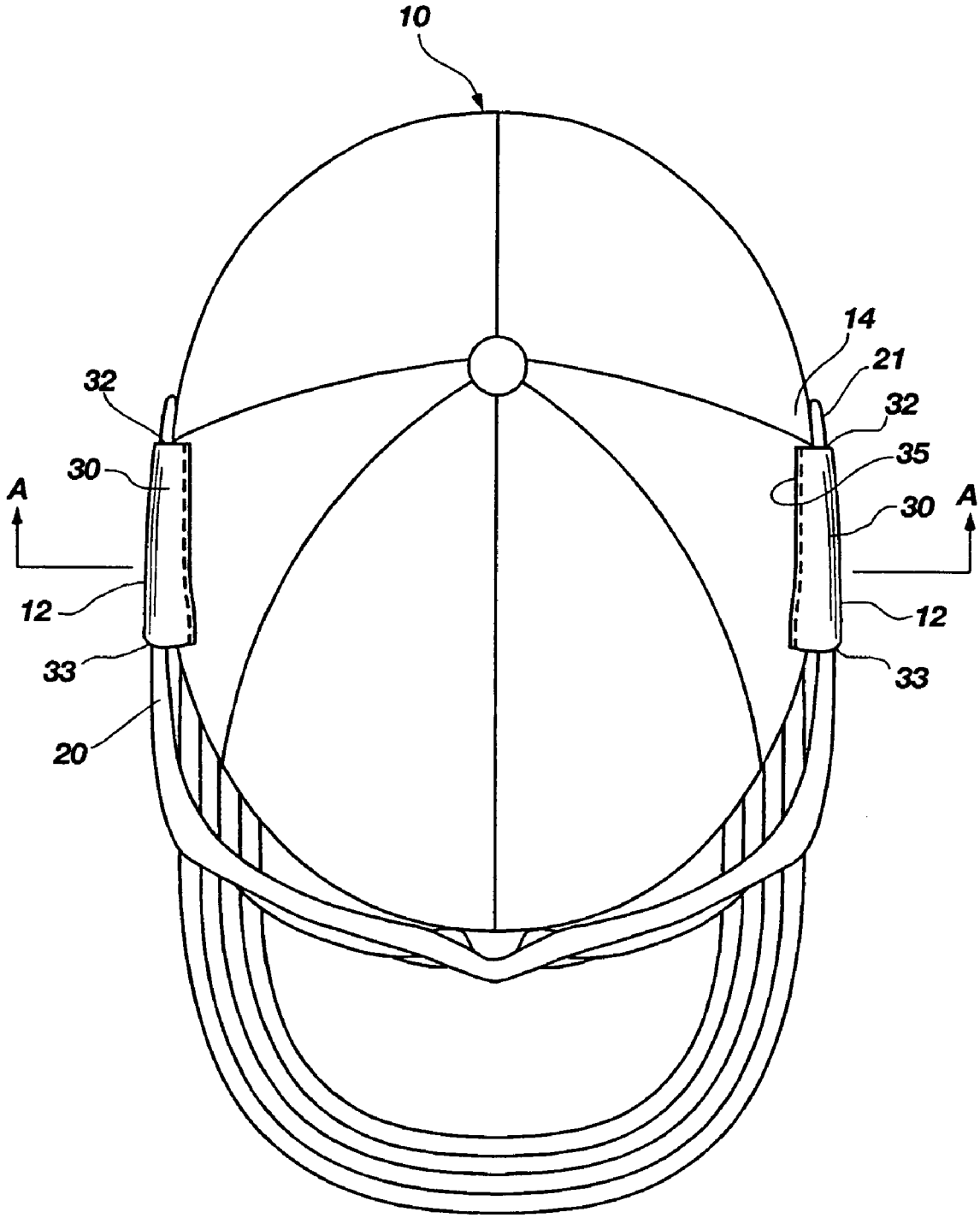
FIG. 3 is a top view of the embodiment of the disclosure of FIG. 1 or 2, depicting a storage position of an article in accordance with the principles of the present disclosure.

A holder, indicated by bracket 12 as shown in an exploded view in FIG. 1, may be disposed on one or more sides of the headwear member 10 for receiving an article 20, such as sunglasses. For example, a second holder 12 may be position on an opposite side of the headwear 10, as shown in FIG. 3, so that opposing temples of the sunglasses may each be received in a holder 12. The term article as used herein shall be construed broadly to include various different items that may be desirable for a user to hold on the headwear 10. For example, the article 20 may include items such as eyewear, including sunglasses, safety glasses or prescription glasses. The article 20 may also include items such as tools, including screw drivers, pliers, laser pointers, or flash lights, or any other item desired to be held on a user's headwear.

In the embodiment of FIG. 1, the holder 12 may be formed by attaching a cover 30 on an exterior surface 14 of the headwear 10. The cover 30 may be configured as a strip formed of any of various different types of materials. For example, the cover 30 may be formed of a material similar to that of the hat, such as a fabric, or elastic material, leather or any other suitable material known to those skilled in the art. One illustrative embodiment of the cover 30 may be formed as a substantially flat, flexible, polygonal member including a rear edge 32, a front edge 33, an upper edge 35 and a lower edge 36. The front edge 33 may define an entrance to the holder 12 and may be configured to face a front of the headwear 10. The rear edge 32 may be opposite the front edge 33 and may be configured to face a rear of the headwear 10. The cover 30 may be configured to define the holder 12 with a portion of the exterior surface 14 of the headwear 10 to slideably receive the rearmost portion 21 of an article 20 to be stored securely on the headwear 10. It will be understood that other embodiments of the present disclosure may include covers of different shapes and sizes, and that other embodiments may also be oriented in different configurations on the headwear 10, such that the entrance of the holder 12 may extend in different directions in alternative embodiments.

The cover 30 may be attached to the exterior surface 14 of the headwear using stitches 34 or adhesives or any other suitable attaching mechanism known in the art. In one illustrative embodiment, the upper edge 35 and the lower edge 36 may be attached to the headwear 10 along substantially an entire length of the cover 30. Other embodiments of the holder may be attached at intervals along the upper edge 35 and the lower edge 36. Moreover, other embodiments of the present disclosure may include at least a portion of the rear edge 32 attached to the headwear 10.

In the illustrative embodiment of FIG. 1, a gripping means 50 may be disposed on an interior surface of the holder 12 for gripping the article 20. One illustrative embodiment of the gripping means may include VELCRO™ hook and loop fasteners positioned on the exterior surface 14 of the headwear 10 and the interior surface 31 of the cover 30. Accordingly, when a rear portion 21 of an article 20 is placed in the holder 12, the cover 30 may be pressed such that the VELCRO™ hook and loop fasteners connect to provide a space within the holder 12 that more closely corresponds to the shape of the article 20 to assist in holding the article 20 in position within the holder 12. The gripping means 50 may also allow the holder 12 to more securely hold the articles 20 even when the headwear 10 is removed from the user. It will be understood that the gripping means 50 may be sized to cover substantially the entire interior area of the holder 12, or the gripping means 50 may be smaller than the area of the holder 12 so as to cover only a portion of the holder 12. For example, the gripping means may be sized to extend along a half or a third of the cover.

Another illustrative embodiment of the gripping means 50 may include a ductile layer or sheet member within the holder 12. The ductile sheet member may be positioned on an interior surface 31 of the cover 30 and an exterior surface 14 of the headwear 10. Alternatively, the ductile sheet member may be positioned only on the interior surface of the cover 30. The ductile sheet member may be formed of a metal material for example, such as a metal foil, such that the ductile sheet member may be deformed to correspond to the shape of the article 20 and thereby assist in holding the article 20 within the holder 12. The ductile sheet member may be capable of deforming in a plastic manner and may have memory characteristics to remain in the deformed condition. It will be understood that the gripping means 50 may also be formed of any other suitable material for assisting in holding the article 20 within the holder 12. It will be appreciated that many different structures can perform the function of the gripping means 50 and that all structures providing similar or equivalent functions, both those now known to those skilled in the art or which become known, are intended to fall within the scope of gripping means. The structure illustrated herein is merely illustrative of the gripping means which fall within the scope of the present invention.

One illustrative embodiment of the holder 12 may have an elongate configuration for supporting elongate articles 20. For example, the holder may have a length dimension that is longer than the height, such as approximately 1.5 to 3 times the height, or more specifically, a length that is two times the height. One embodiment of the holder 12 may be dimensioned approximately three inches in length and 1.5 inches in height, for example. The reduced dimension of the height as compared to the length may allow the article 20 to be held in position without allowing excessive rotation of the article 20. It will also be understood that alternative storage positions may be possible, as discussed more fully below with regard to FIGS. 21-31. Accordingly, the article 20 may be held securely in place even without the assistance of other structures, such as a visor portion of the headwear 10. Moreover, the holder 12 may be positioned or oriented in other directions and still be able to support the article 20. For example, the holder 12 may be oriented in a direction opposite that shown in FIG. 1, such that the entrance to the holder 12 may face a rear of the headwear 10 or some other direction. Accordingly, the headwear 10 may be worn backwards, as is sometimes done with baseball caps, and still provide support for securely holding articles 20. It will be understood that the holder 12 may be arranged in various different orientations, and may include various different dimensions all which fall within the scope of the present disclosure.

It will be appreciated that in the embodiment of FIG. 1, the holder 12 may be defined at least in part by an interior surface 31 of the cover 30 and an exterior surface 14 of the headwear 10. Other embodiments of the holder 12 will be discussed more fully below.

Figure 2:
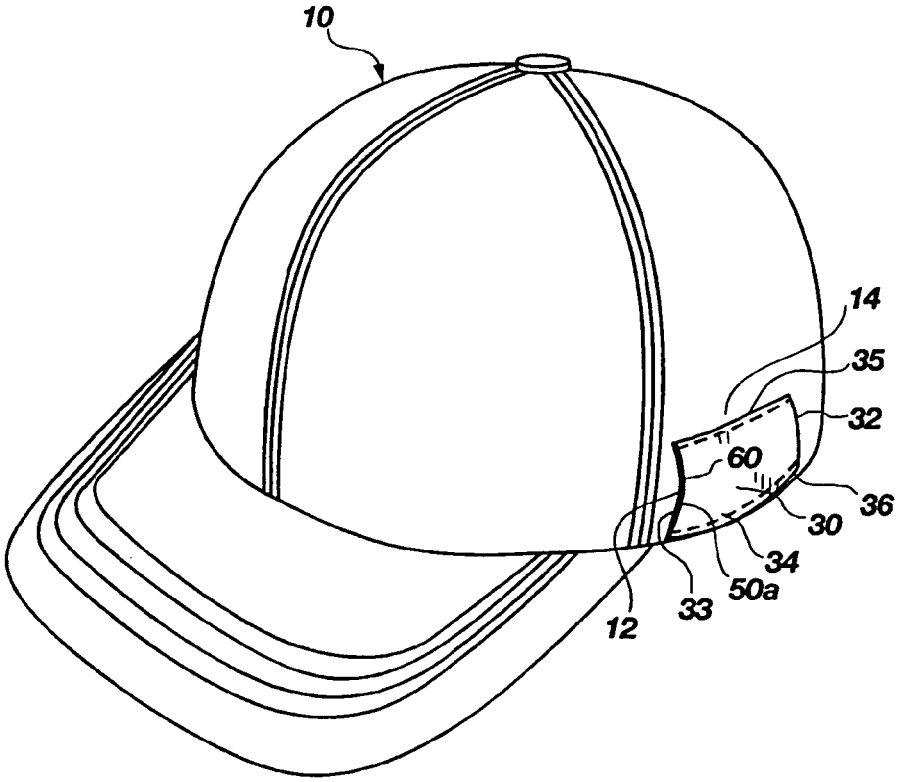
FIG. 2 is a perspective, three-dimensional view of an additional embodiment of the externally mounted utility holder.

Referring to FIG. 2, a perspective view of another illustrative embodiment of the gripping means 50*a* of the present disclosure is shown. It will be understood that the illustrative embodiment depicted in FIG. 2 contains many of the same features as the embodiment disclosed in FIG. 1, and only the pertinent different features will be discussed herein to more succinctly describe the characteristics of the embodiment of the disclosure depicted in FIG. 2.

Shown in FIG. 2, a ductile member 60 may be positioned adjacent the front edge 33 of the cover 30. The ductile member 60 may be in the form of a metal wire, such as a solid gauge copper or tin wire for example, and may extend along substantially the entire dimension of the front edge 33.

The ductile member 60 may also extend along at least a portion of the upper edge 35 and/or the lower edge 36 to provide additional support. The ductile member 60 may be attached to the cover by sewing, adhesives, or any other attaching mechanism known to those skilled in the art. It will be understood that the configuration of the ductile member 60 may vary within the scope of the present disclosure as will be appreciated by those skilled in the pertinent art. The ductile member 60 may have various different cross-sectional shapes and dimensions, as well as different lengths.

Some embodiments of the ductile member 60 may be positioned strictly on the front edge 33, while other embodiments of the ductile member 60 may encompass the entire perimeter of the cover 30. Alternatively, the ductile member 60 may be positioned at other locations away from the edges of the cover 30. The ductile member 60 may also allow the holder 12 to more securely hold the articles 20 even when the headwear 10 is removed from the user.

It will be appreciated that, very desirably, the ductile member 60 may be deformed so as to conform to the shape of an article 20 positioned in the holder 12 such that the ductile member 60 may assist in holding the article in place within the holder 12. The ductile member 60 may have plastic deformation characteristics and position memory characteristics such that once deformed, the ductile member may remain in position until acted upon by another deformation force. The benefits of providing the ductile member, or structure performing the same or equivalent functions, to the user will be appreciated by those skilled in the art. Those skilled in the art can readily arrive at additional structures which perform the same or equivalent functions as those carried out by the ductile member, such as those functions carried out by the gripping means disclosed herein.

Referring to FIG. 3, a top view of an illustrative embodiment of the present disclosure is shown in which the externally mounted cover 30 is attached to opposing sides of the headwear 10. Also, the resulting storage position of an article 20, such as a pair of sunglasses is depicted in accordance with the embodiments shown in FIGS. 1 and 2.

Figure 4:
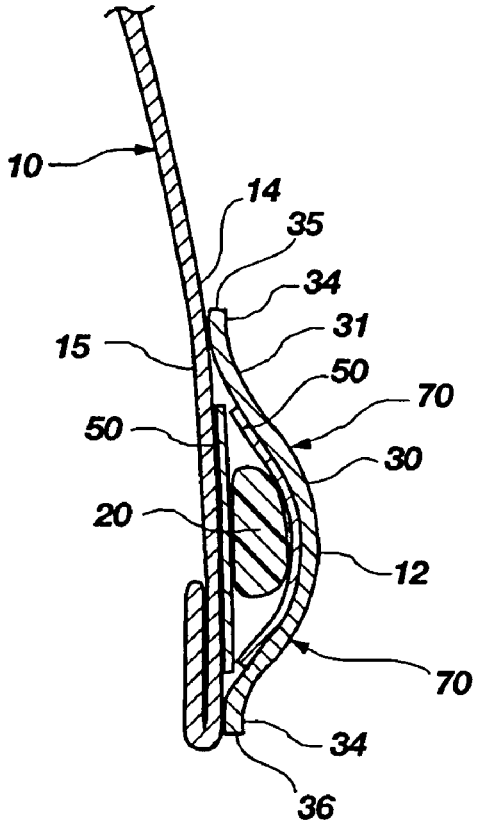
FIG. 4 is a front view of a portion of cross section A-A of the externally mounted utility holder as it is attached to the outside of the headwear, according to the embodiment of FIG. 1 of the disclosure.

Referring to FIG. 4, a partial cross-sectional front view is shown as viewed from line A-A of FIG. 3, showing the embodiment of the gripping means 50 as presented in FIG. 1. The cover 30 may be mounted using stitches 34 or the like to the exterior surface 14 of the headwear 10. In addition, the gripping means 50 is shown disposed between the exterior surface 14 of the headwear 10 and the inner surface of the cover 30. Arrows 70 depict an area where pressure may be applied to the gripping means 50 to modify its shape and facilitate improved hold on an article 20 within the holder 12.

Figure 5:
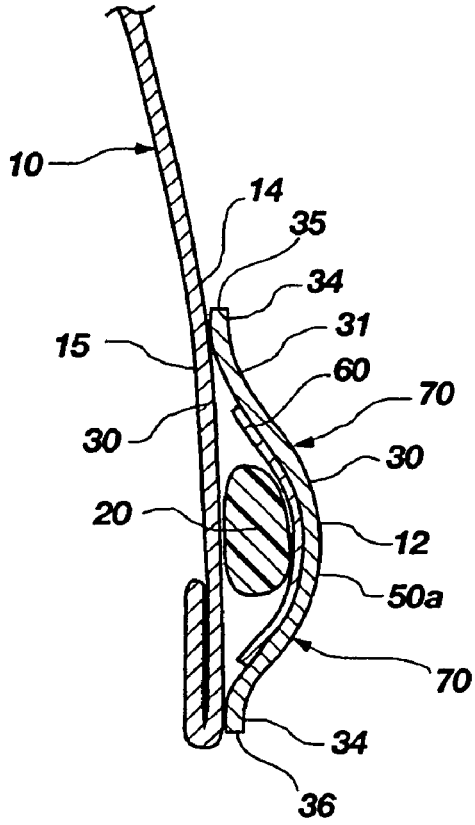
FIG. 5 is a front view of a portion of cross section A-A of the externally mounted utility holder as it is attached to the outside of the headwear, according to the embodiment of FIG. 2 of the disclosure.

Similarly, referring to FIG. 5, a partial cross-sectional front view is shown as viewed from line A-A of FIG. 3, showing the gripping means 50*a* embodiment including the ductile member 60 as presented in FIG. 2. Again, the cover 30 may be mounted using stitches 34 or the like to the outside surface of the headwear 10. In addition, the ductile member 60 is shown disposed on the inner surface of the cover 30. Very desirably, arrows 70 depict an area where pressure may be applied to the ductile member 60 to modify its shape and facilitate improved hold on an article 20.

Figure 6:
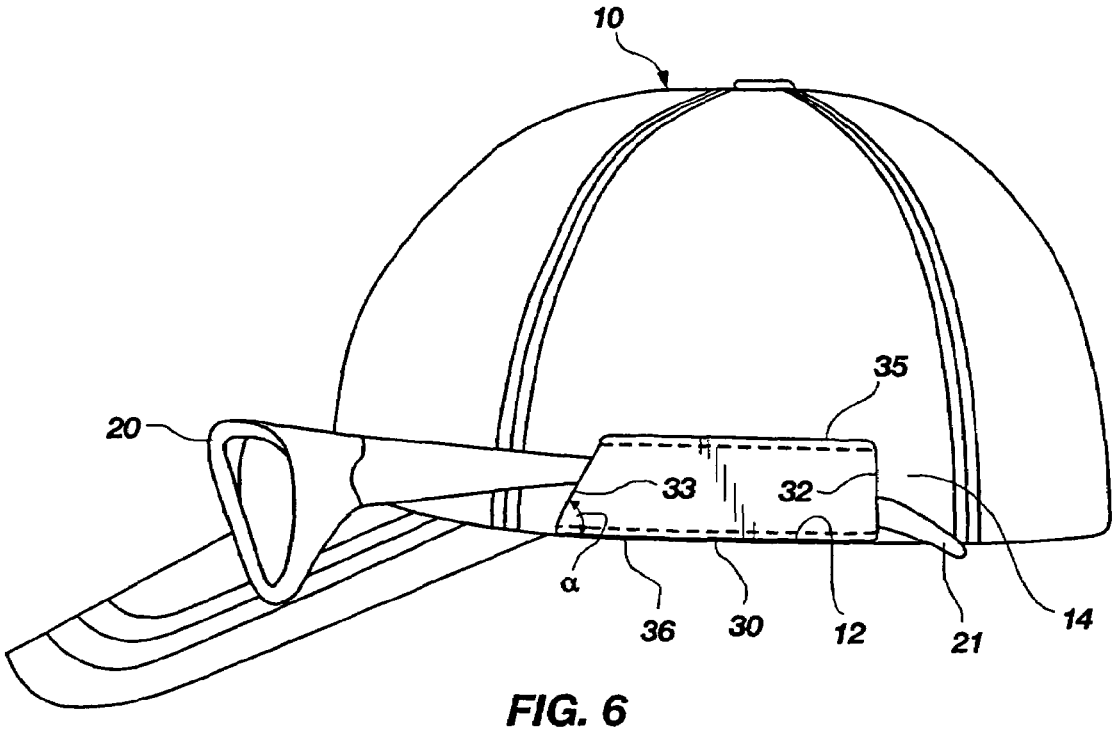
FIG. 6 is a side view showing an externally mounted utility holder assembly depicting a resulting storage position of an article.

Referring now to FIG. 6, a side view of the present disclosure is shown. It will be understood that the illustrative embodiment depicted in FIG. 6 may include the exemplary gripping means 50 as depicted in FIG. 1, or the exemplary gripping means 50*a* including the ductile member 60, as depicted in FIG. 2, or the illustrative embodiment as depicted in FIG. 6 may not include the gripping means 50, 50*a*. The cover 30 may be configured such that the front edge 33 may be disposed at an angle $\alpha$ with respect to the lower edge 36 within a range of between from approximately 45 to approximately 75 degrees. One illustrative embodiment of the front edge 33 may be disposed at an angle $\alpha$ of approximately 60 degrees. It will be appreciated, however, that other illustrative embodiments may include the front edge 33 at different angles $\alpha$ within the scope of the present disclosure. The angle $\alpha$ on the front edge 33 may provide an advantage of allowing for facilitated insertion of the article 20 into the holder 12, particularly when the rear portion 21 of the article 20 is curved downwardly, as is commonly the case with eyewear. The angled front edge 33 may provide a larger entrance to the holder 12 and may facilitate access to the pocket from an upward direction. This may be beneficial for facilitating insertion of articles 20, particularly when the holder 12 is used with headwear 10 having a visor, such as is commonly provided with baseball caps, for example.

Figure 7:
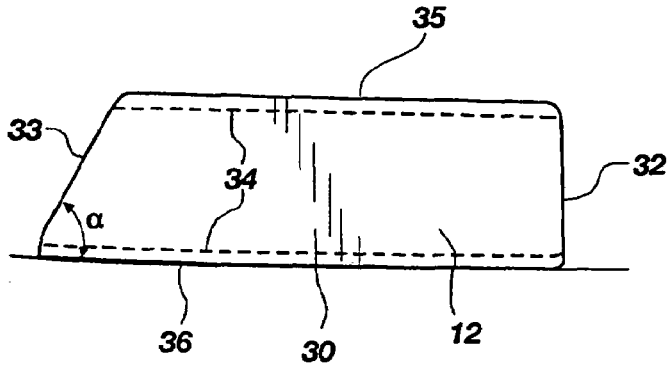
FIG. 7 is a side view showing in greater detail an embodiment of the shape and dimensions of an externally mounted utility holder.

An enlarged view of the holder 12 is depicted in FIG. 7, which shows a detailed side view of the cover 30 of the present disclosure. The front edge 33 is shown disposed at an angle $\alpha$, which may be within a range of from between approximately 45 to approximately 75 degrees, or more specifically, at 60 degrees, for example.

Figure 8:
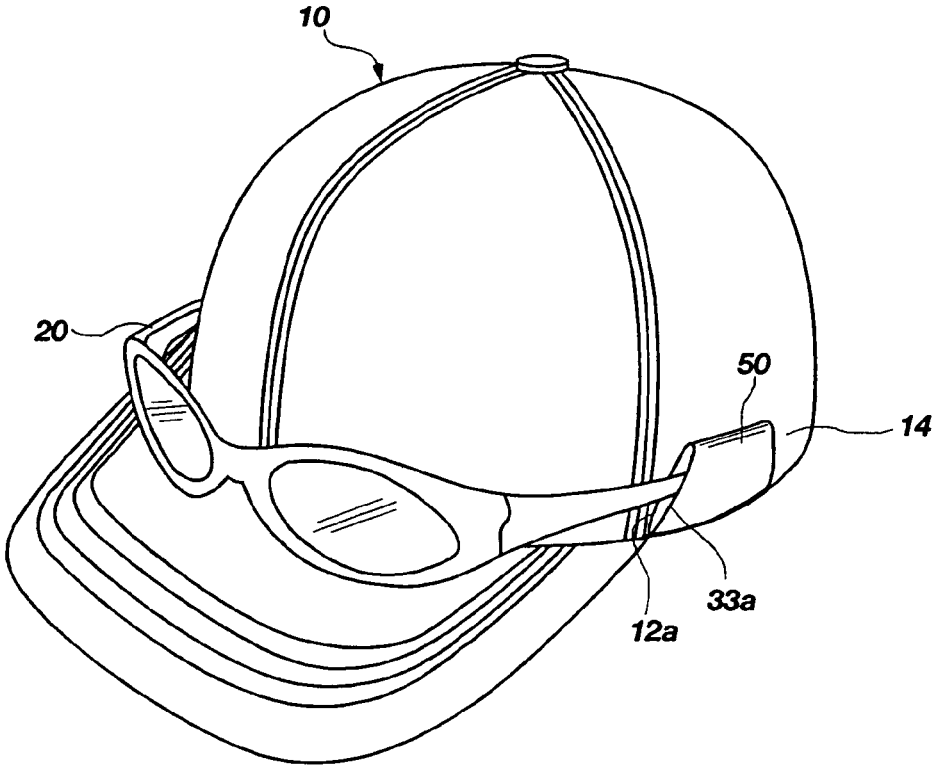
FIG. 8 is a perspective, three-dimensional view of one embodiment of an internally mounted utility holder with an article inserted, according to another embodiment of the present disclosure.
Figure 11:
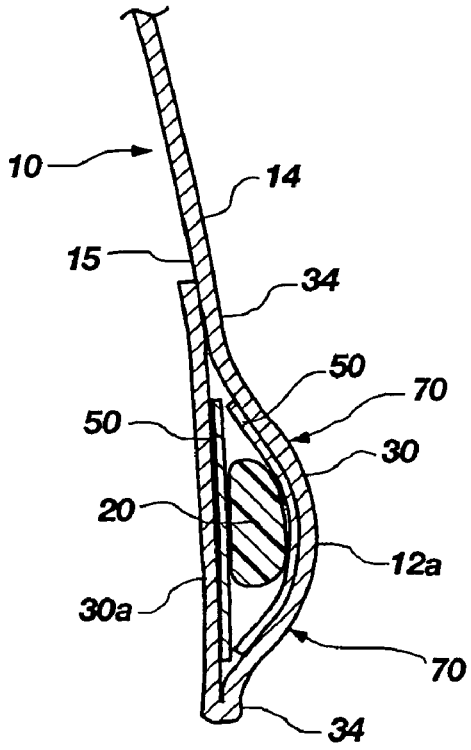
FIG. 11 is a front view of a portion of cross section B-B in FIG. 10, of the internally mounted utility holder assembly as it is mounted to the inside of the headwear, according to the embodiment of FIG. 8.
Figure 12:
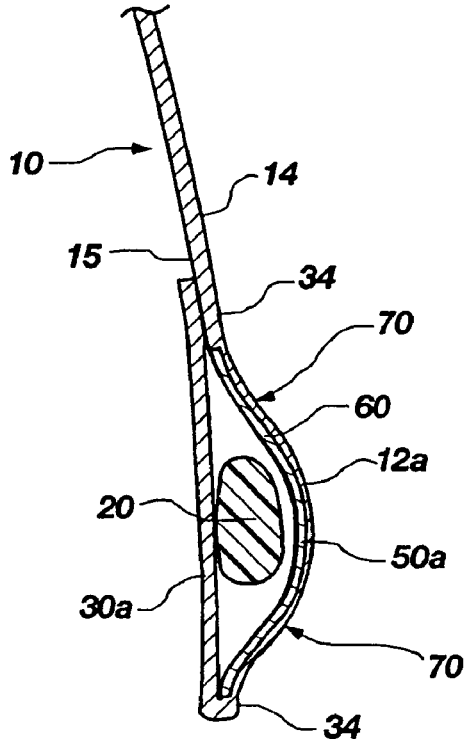
FIG. 12 is a front view of a portion of cross section B-B in FIG. 10, of the internally mounted utility holder assembly as it is mounted to the inside of the headwear, according to the embodiment of FIG. 9.

Referring to FIG. 8, a perspective view of another alternative illustrative embodiment of the present disclosure is shown, in which a holder 12*a* may be disposed on an interior surface 15 of the headwear 10, as shown most clearly in FIGS. 11 and 12. An entrance 33*a* of the holder 12*a* may be defined in the exterior surface 14 of the headwear 10, such that the entrance 33*a* may be the only portion of the holder 12*a* visible from the exterior of the headwear 10. Similar to the previously described illustrative embodiments, the holder 12*a* may be configured to slideably receive the rearmost portion 21 of an article 20 to be stored securely. In addition, similar to the illustrative embodiment of FIG. 1, a gripping means 50, such as a VELCRO™ hook and loop fastener or a layer with a plastic memory capability, such as foil, or other similar material may be mounted on the inside surfaces of the holder 12*a*.

Figure 9:
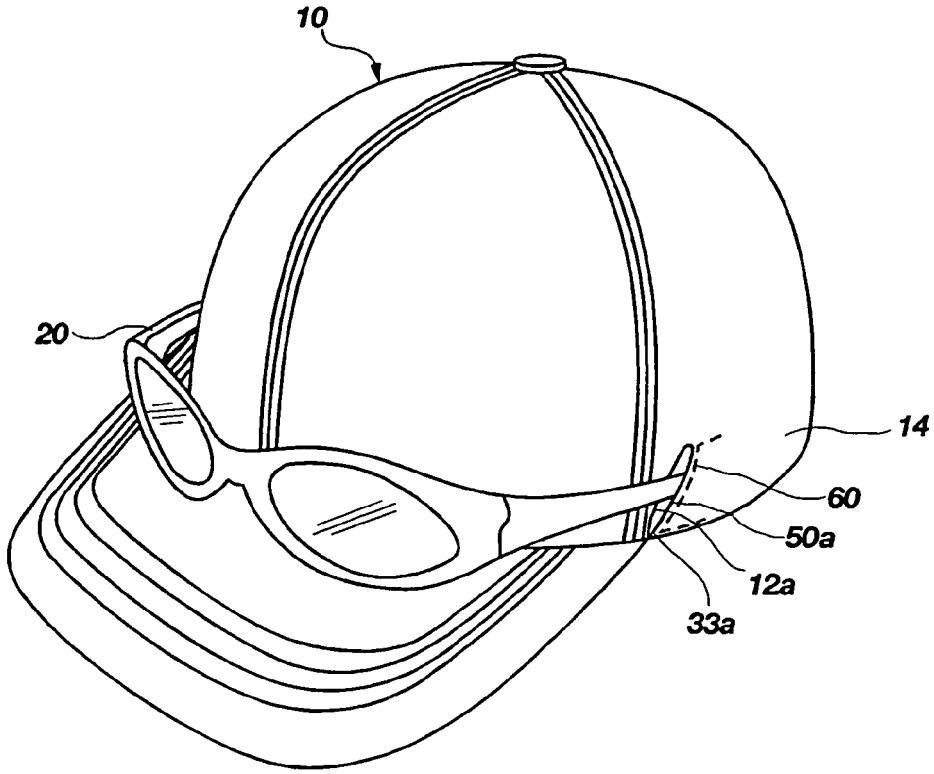
FIG. 9 is a perspective, three-dimensional view of another embodiment of an internally mounted utility holder with an article inserted, according to the principles of the present disclosure.

Similarly, as shown in FIG. 9, which shows a perspective view of another illustrative embodiment of the present disclosure, the headwear 10 may include a holder 12 designed to slideably receive the rearmost portion 21 of an article 20 to be stored securely in the pocket. In addition, a gripping means 50*a* (shown in phantom image in FIG. 9) in the form of a ductile member 60 having a plastic memory capability, such as a wire, or other similar material, may be mounted inside the holder 12 at the front edge 33, similar to the embodiment of FIG. 2, except that the holder 12*a* may be provided on an interior of the headwear 10.

Figure 10:
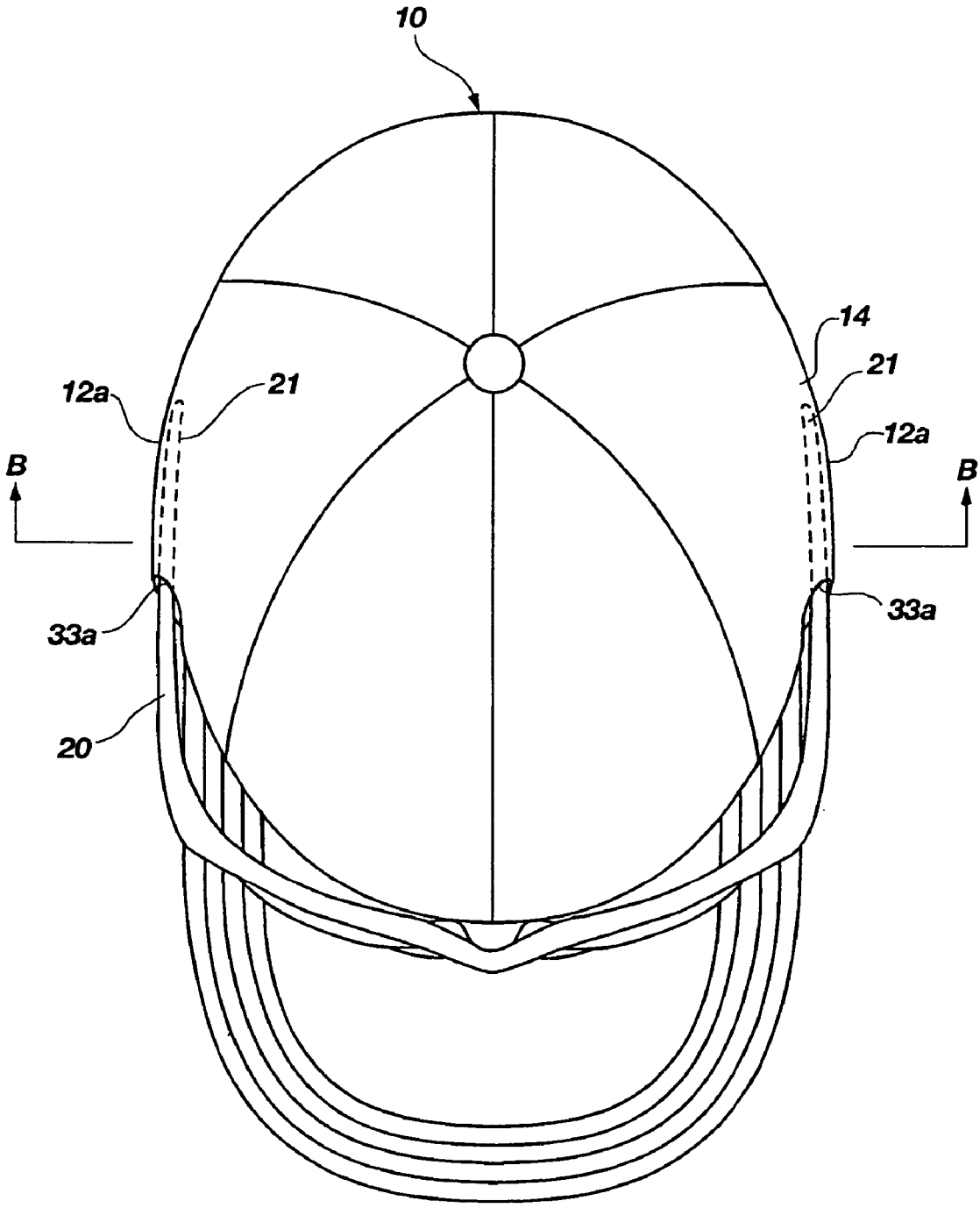
FIG. 10 is a top view of the internally mounted utility holder as depicted in the embodiments of FIGS. 8 and 9 and the resulting storage position of an article.

Referring now to FIG. 10, a top view of the present disclosure is shown in which the internally mounted holder 12*a* is dispose on opposing sides of the headwear 10. Also, the resulting storage position of an article 20, such as a pair of sunglasses is depicted in accordance with the embodiments shown in FIGS. 8 and 9.

Referring to FIG. 11, a partial cross-sectional front view is shown as viewed from line B-B of FIG. 10, showing the illustrative embodiment of the gripping means 50 as presented in FIG. 8. The gripping means 50 is shown disposed on an interior of the holder 12*a*, on an interior side of the headwear 10. Arrows 70 depict an area where pressure may be applied to the gripping means 50 to modify its shape and facilitate improved hold on an article 20.

An interior cover 30*a* may be provided on an interior side of the headwear 10 to define a pocket for receiving the article 20, and to protect the user's head from contact with the article 20. The interior cover 30*a* may be attached to the headwear 10 using stitches 34 or any other type of connecting mechanism, similar to the previously described embodiments. The interior cover 30*a* may be configured to extend to substantially an entire dimension of the article 20. Alternatively, the interior cover 30*a* may be configured to cover only a portion of the article 20. One illustrative embodiment of the interior cover 30*a* may have an elongate configuration for supporting elongate articles 20. For example, similar to previously described embodiments, the interior cover 30*a* may have a polygonal shape having a length dimension that is longer than the height, such as approximately 1.5 to 3 times the height, or more specifically, a length that is two times the height. One illustrative embodiment of the interior cover 30*a* may be dimensioned approximately three inches in length and 1.5 inches in height, for example. The reduced dimension of the height as compared to the length may allow elongate articles 20 to be held in position without allowing excessive rotation of the article 20 or contact with the user's head. Accordingly, the article 20 may be held securely in place even without the assistance of other structures. Moreover, it will also be understood that some embodiments of the present disclosure may be provided such that the holder 12*a* may be provided without an interior cover 30*a*, such that the article 20 may be exposed on the interior surface 15 of the headwear 10.

Similarly, referring to FIG. 12, a partial cross-sectional front view is shown as viewed from line B-B of FIG. 10, showing the illustrative embodiment of the gripping means 50*a* including the ductile member 60 as presented in FIG. 9. The ductile member 60 may be mounted inside a seam or surface of the holder 12*a*. Points 70 depict an area to apply pressure to the ductile member 60 to modify its shape to facilitate improved hold on an article 20.

Figure 13:
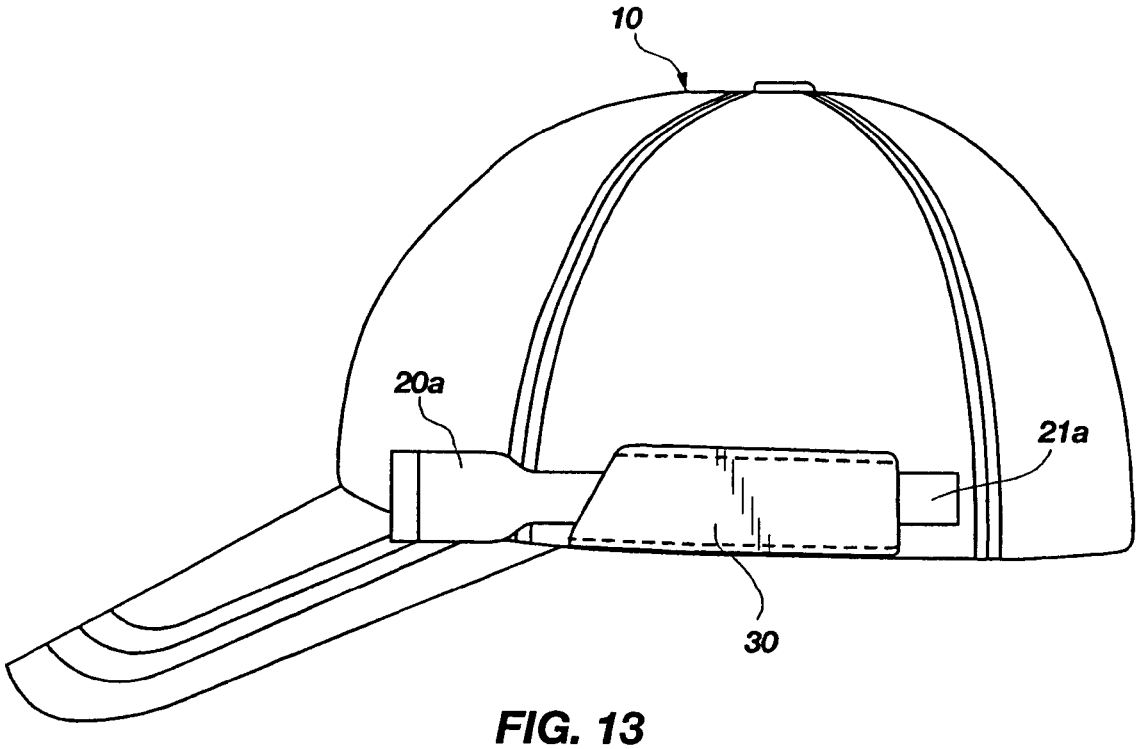
FIG. 13 is a side view showing the utility holder assembly and a resulting storage position of an article, such as a small flashlight, according the embodiments of the disclosure of FIG. 1 or 2.

Referring now to FIG. 13, a side view is shown, wherein a headwear 10 comprises the holder 30. The resulting storage position of an article 20*a*, such as a flashlight, is also depicted. It will be understood that a gripping means 50, 50*a* may also be provided in the holder 30, within the scope of the present disclosure.

Figure 14:
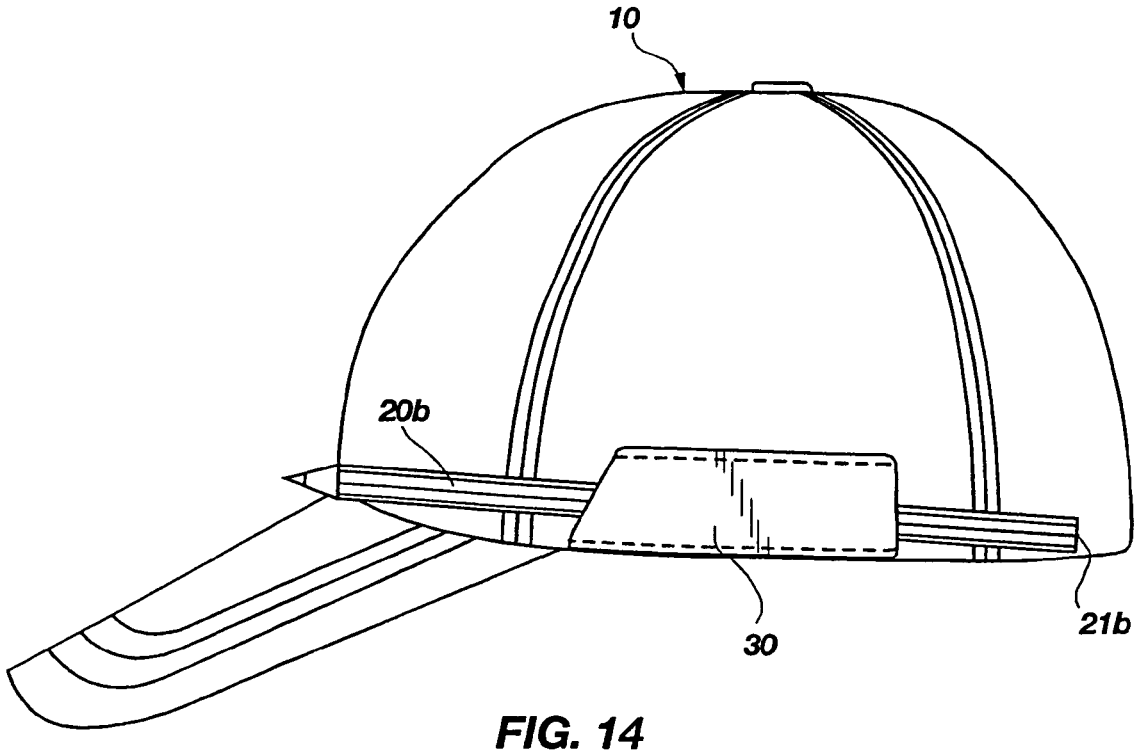
FIG. 14 is a side view showing the utility holder assembly and a resulting storage position of an article, such as a pencil, according the embodiments of the disclosure of FIG. 1 or 2.

Referring next to FIG. 14, a side view is shown, wherein the headwear 10 comprises the holder 30. The resulting storage position of an article 20*b*, such as a writing utensil or pencil, is also depicted. Similar to the illustrative embodiments previously discussed, it will be understood that a gripping means, such as gripping means 50 or gripping means 50*a*, may also be provided in the holder 30, within the scope of the present disclosure, though such may not be visible in the depiction of FIG. 14.

Figure 15:
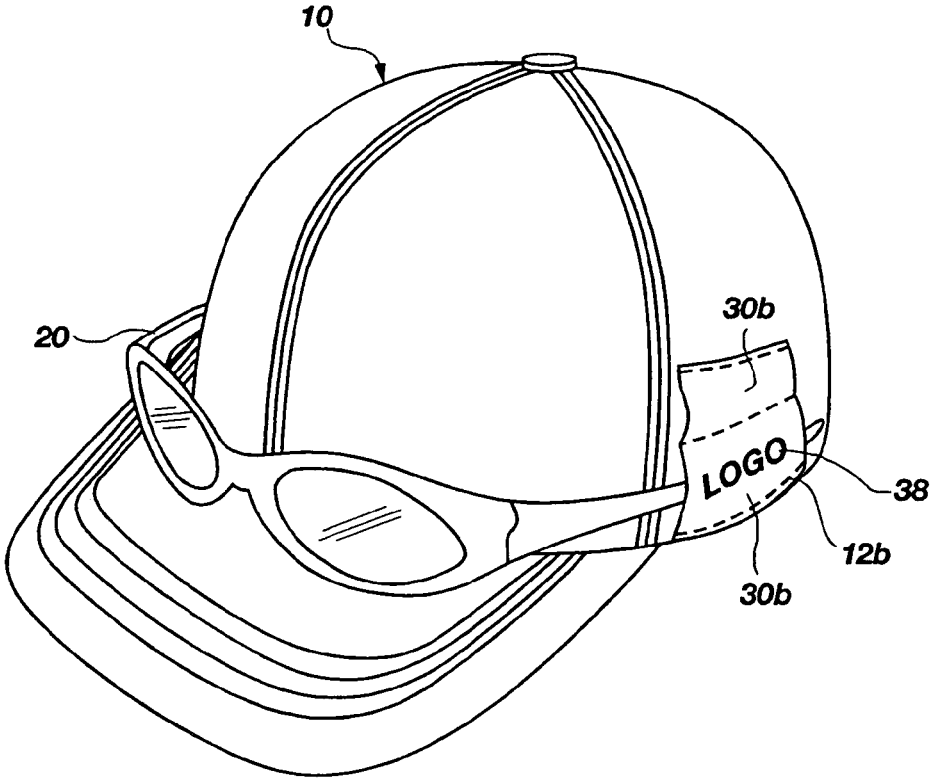
FIG. 15 is a perspective, three-dimensional view of an embodiment of a utility holder having a plurality of pockets mounted to headwear in accordance with the principles of the present disclosure.

Referring now to FIG. 15, a perspective view is shown of an additional embodiment of the present disclosure in which a holder 12*b* may be provided with a plurality of pockets 30*b* for receiving multiple articles 20. For example, the holder 12*b* may be utilized to hold an article 20 in the form of a pair of sunglasses, as well as an article 20*b* in the form of a pencil, at the same time. It will be understood that the holder 12*b* may be attached to the headwear 10 in a manner similar to the embodiments previously discussed. Moreover, similar to the previously discussed embodiments, the holder 12*b* may include a gripping means, such as gripping means 50 or gripping means 50*a*, to facilitate securing the article 20 to the headwear 10. Also as shown in FIG. 15, a logo, product information, or any other variety of indicia 38 may be applied to the holder 12*b*. The indicia 38 may be beneficial for advertising or may be decorative in nature to improve the aesthetic appearance of the holder 12*b*. It will be understood that each of the illustrative embodiments of the present disclosure may include the indicia 38 as depicted schematically in FIG. 15 and may also include a plurality of compartments for holding a plurality of articles simultaneously.

Figure 16:
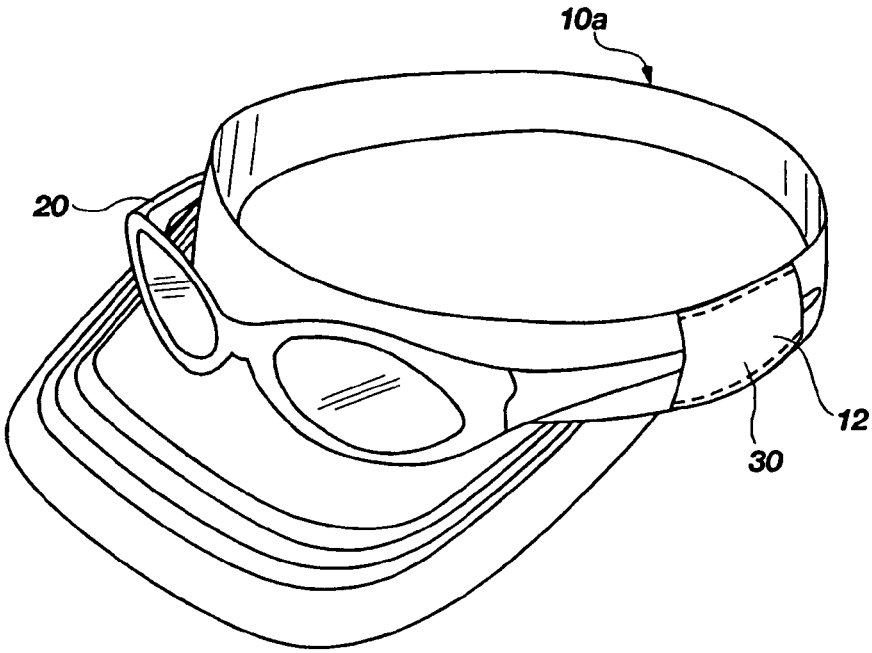
FIG. 16 is a perspective, three-dimensional view of an embodiment of the utility holder mounted to visor style headwear.

Referring now to FIG. 16, a perspective view is shown of headwear 10*a* in the form of a visor, including the holder 12 in accordance with the principles of the present disclosure. The depiction of the headwear 10*a* in the form of a visor is intended to illustrate that the principles of the present disclosure may be utilized with various different types of headwear. Though the depiction of FIG. 16 includes an externally mounted cover 30 to form the holder 12, it will be understood that an internal holder 12*a* may also be used with the headwear 10*a*. Moreover, though an article 20, in the form of sunglasses, is depicted in FIG. 16, it will be understood that various different varieties of articles may be held on the headwear 10*a*.

Figure 17:
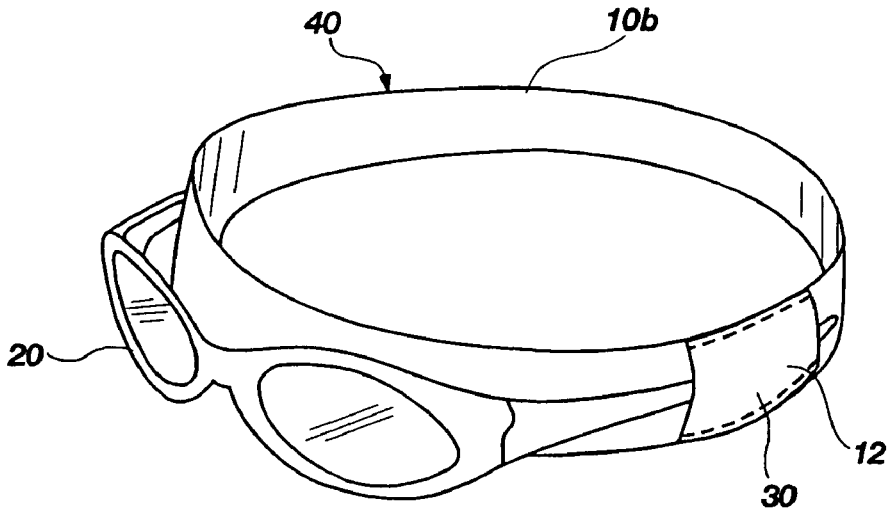
FIG. 17 is a perspective, three-dimensional view of an embodiment of the utility holder assembly mounted to an elastic type headband.

Referring to FIG. 17, a perspective view of an additional variety of headwear 10*b*, in the form of a headband 40, is shown. The headband 40 may be formed of an elastic material to allow the headband 40 to expand and contract to adjust in size. A holder 12 may be positioned on the headband 40 to receive various different kinds of articles 20. It will be understood that the headband 40 may be similarly equipped with an internal holder 12*a*, as described herein. Moreover, similar to the previously discussed embodiments, the holder 12 may include a gripping means, such as gripping means 50 or gripping means 50*a*, to facilitate securing the article 20 to the headwear 10*b*.

Figure 18:
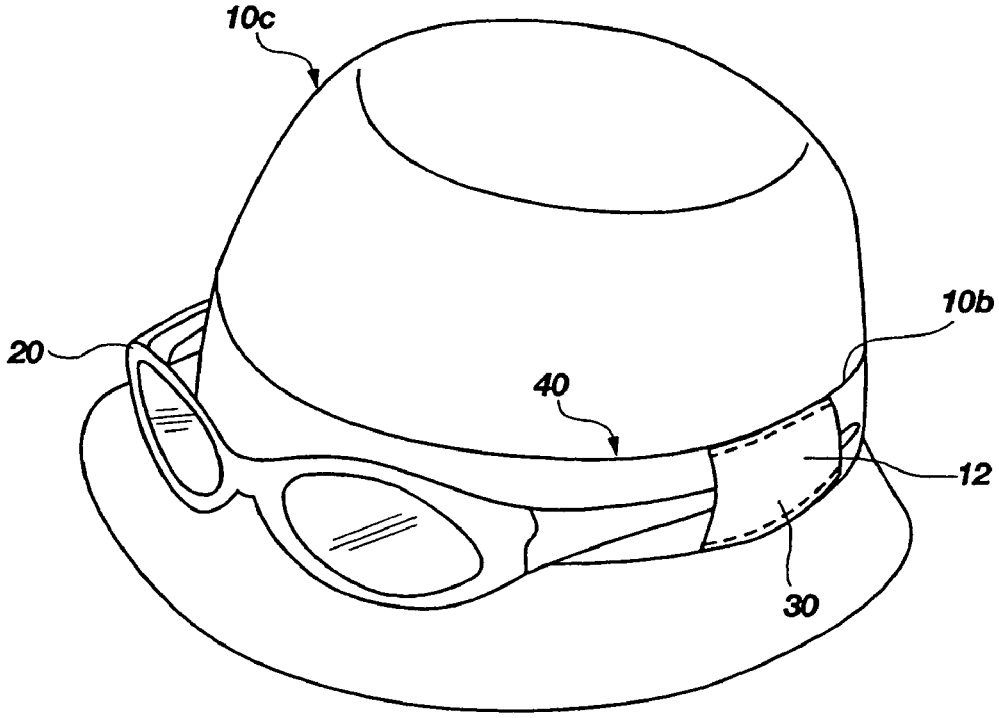
FIG. 18 is a perspective, three-dimensional view of an embodiment of the utility holder assembly mounted to a headband, which is attached interchangeably to various type and styles of headwear, according to the further embodiment of the present disclosure.

Referring now to FIG. 18, a perspective view is shown of yet an additional type of headwear 10*c*, in the form of a hat having the headband 40 placed thereon. It will be understood that various different styles of headwear 10*c* may be provided and the headband 40 may be removably attached to the headwear 10*c*, or the headband 40 may be fixed to the headwear 10*c*. Moreover, the holder, such as holder 12 or holder 12*a*, may be directly disposed on the headwear 10*c* without the headband 40. Accordingly, the principles of the present disclosure may be versatile such that various different combinations of headwear may be utilized to hold an article 20 to the headwear corresponding to the needs or desired styles for a particular user.

Figure 19:
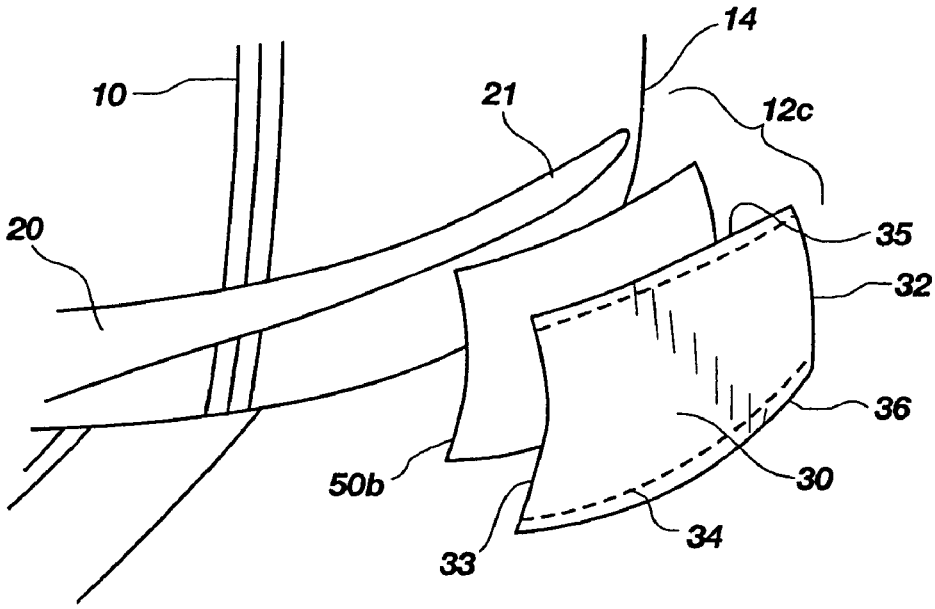
FIG. 19 is a break-away perspective, three-dimensional exploded view of another embodiment of an externally mounted utility holder with an article inserted.

Referring to FIG. 19, a break-away perspective view of another embodiment of a holder, indicated by bracket 12*c*, is shown in an exploded view. It will be understood that the illustrative embodiment depicted in FIG. 19 contains many of the same features as the embodiments discussed above, and only the pertinent different features will be discussed herein to more succinctly describe the characteristics of the embodiment of the disclosure depicted in FIG. 19.

FIG. 19 depicts another illustrative embodiment of the gripping means 50*b* of the present disclosure. The gripping means 50*b* may include a material configured for gripping the article 20, such as a piece of foam rubber, disposed within the holder 12*c*. It will be understood that other materials known in the art for improving the ability of the holder 12*c* to grip the article 20 may be used. The foam rubber gripping means 50*b* may be allowed to compress to form a tighter contact with the article 20. Moreover, the foam rubber material may allow the holder 12*c* to contact the article 20 such that the frictional characteristics of the holder 12*c* may be improved to prevent the article 20 from sliding out of the holder.

Figure 20:
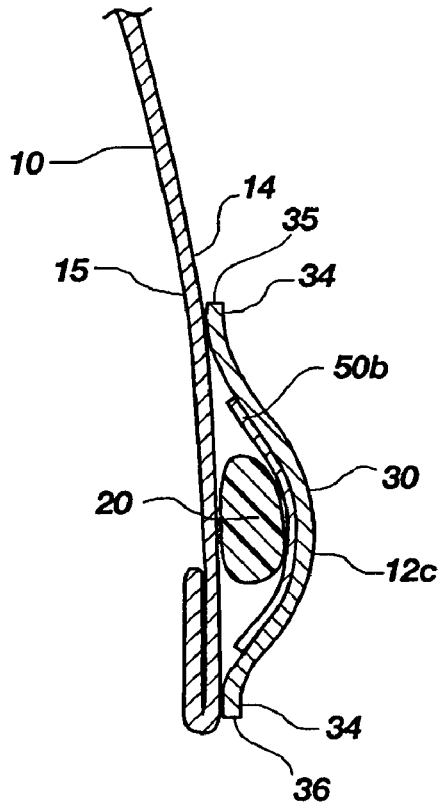
FIG. 20 is a front cross-sectional view of the externally mounted utility holder as it is attached to the outside of the headwear, according to the embodiment of FIG. 19 of the disclosure.

As shown in FIG. 20, which shows a cross-sectional view of the holder 12*c*, the gripping means 50*b* may be disposed on an interior side of the cover 30. However, it will also be understood that the gripping means 50*b* may also, or alternatively, be disposed on the exterior surface 14 of the headwear 10, or the gripping means 50*b* may be utilized in the alternative embodiment holders 12*a*, or 12*b*.

Referring to FIGS. 21-24, a break-away side view of another embodiment of a holder 12*d* is shown. It will be understood that the illustrative embodiment depicted in FIGS. 21-24 contains many of the same features as the embodiments discussed above, and only the pertinent different features will be discussed herein to more succinctly describe the characteristics of the embodiment of the disclosure depicted in FIGS. 21-24.

Figure 21:
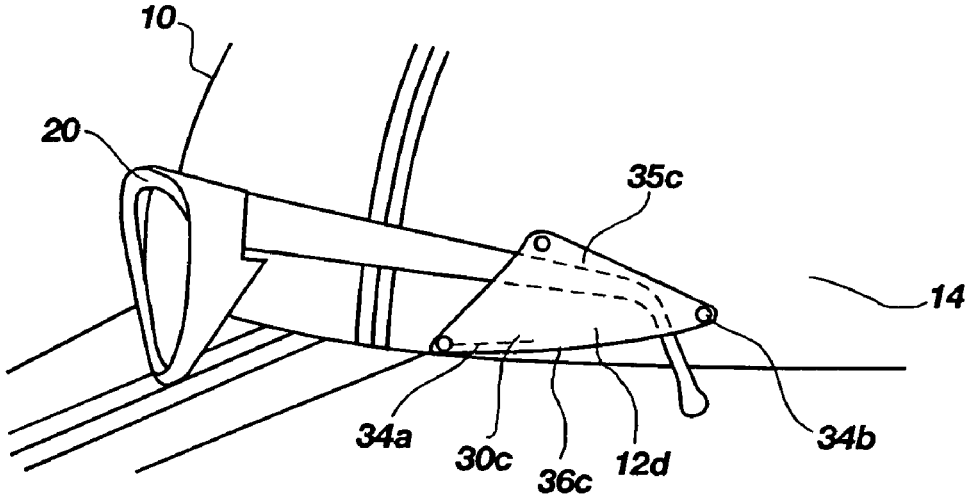
FIG. 21 is a break-away side view of an additional embodiment externally mounted utility holder assembly depicting a resulting storage position of an article.
Figure 22:
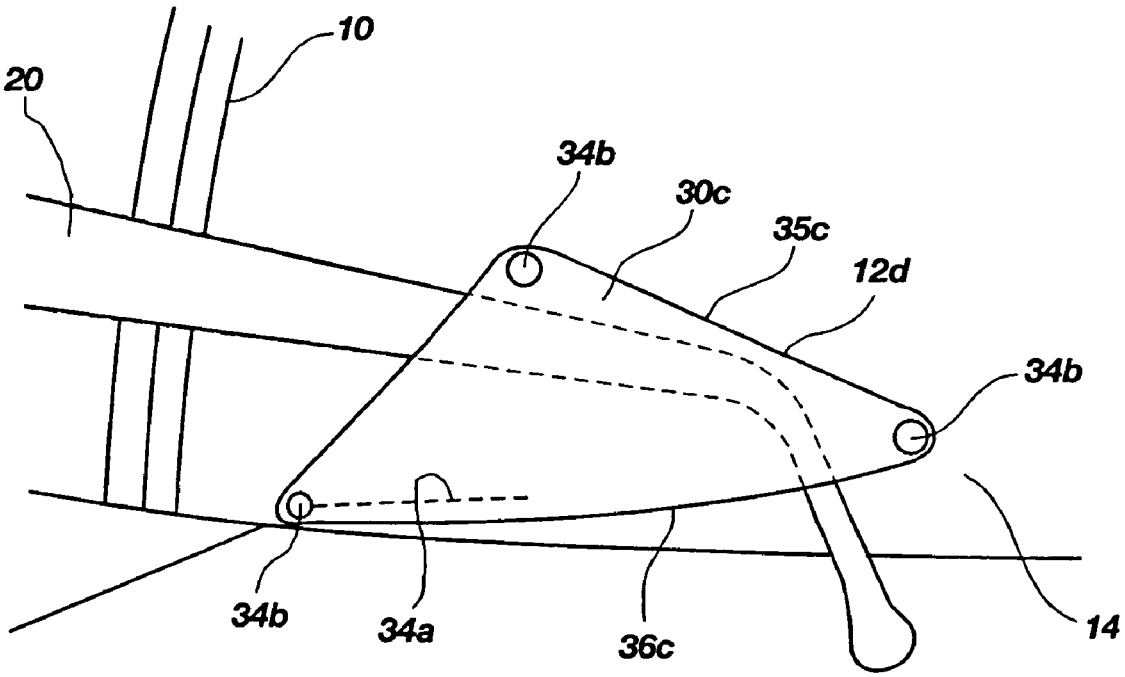
FIG. 22 is a break-away side view showing the externally mounted utility holder of FIG. 21 enlarged.
Figure 23:
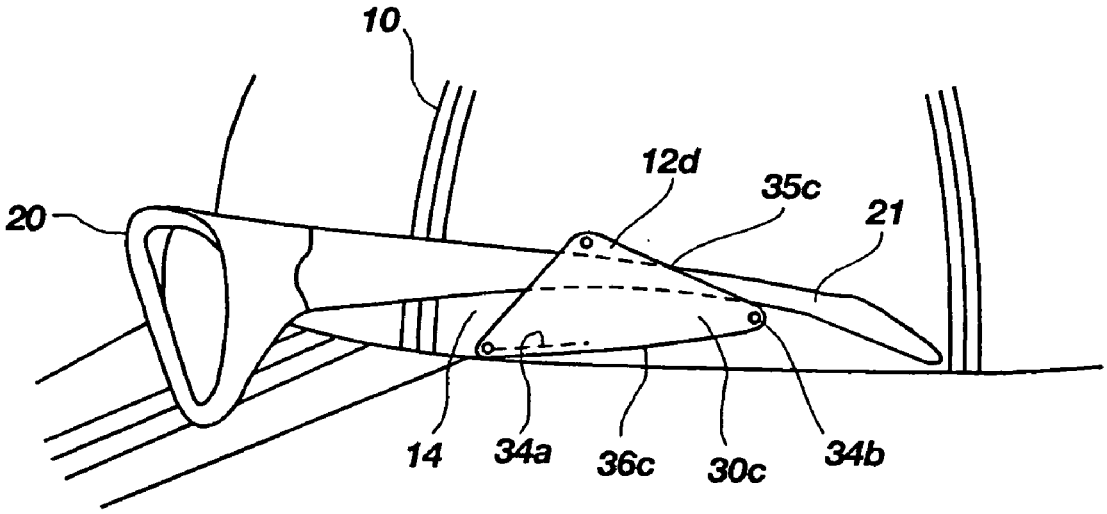
FIG. 23 is a break-away side view of the externally mounted utility holder assembly embodiment of FIG. 21, depicting a resulting storage position of an alternative embodiment article.
Figure 24:
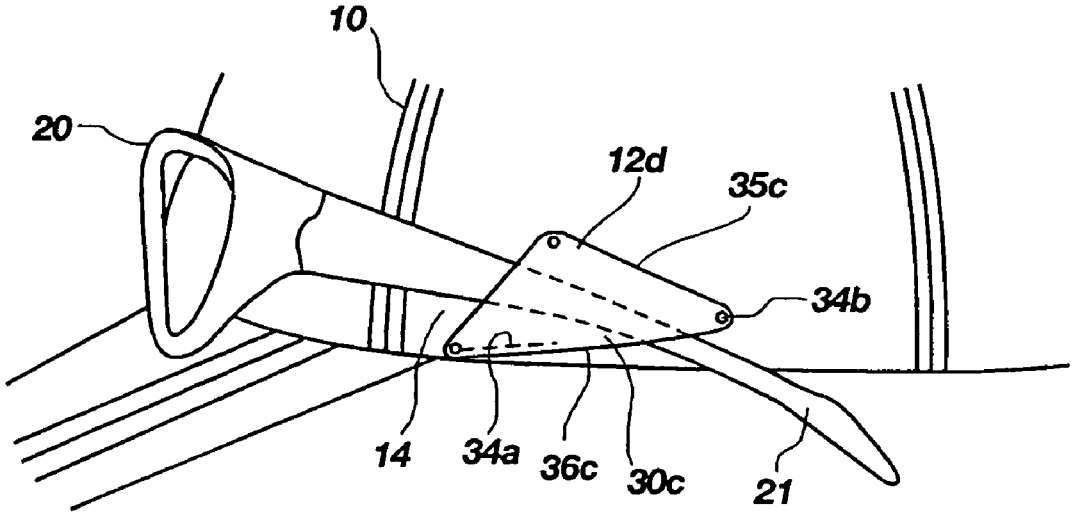
FIG. 24 is a break-away side view of the externally mounted utility holder assembly embodiment of FIG. 21, depicting an alternative storage position of an article.

The holder 12*d* may include a cover 30*c* that may be somewhat triangular in shape. The cover 30*c* may be attached to the exterior surface 14 of the headwear 10 by a continuous stitching 34*a* extending along a portion or all of a lower edge 36*c* of the cover 30*c*. The cover 30*c* may also be attached to the headwear 10 using point or area stitches 34*b*, or other attachment mechanisms known in the art, which may be positioned at corners of the cover 30*c*. It will be understood that the embodiment of the holder 12*d* as depicted in FIGS. 21-24 may include the cover 30*c* which allows access to an interior of the holder 12*d* through the upper edge 35*c* and the lower edge 36*c*, as well as the front edge 33*c*. Accordingly, the article 20 may be stored in the holder 12*d* in various different positions. For example, an article 20 having a curved temple or earpiece, as is common in eyeglasses, may extend through the lower edge 36, as shown in FIGS. 21 and 22. Articles 20 having somewhat straight rearmost portions 21 may also be positioned to extend through the lower edge 36*c* as shown in FIG. 24. Alternatively, the articles 20 may be positioned to extend through the upper edge 35*c* as shown in FIG. 23.

It will be understood that the cover 30*c* may have various different shapes within the scope of the present disclosure, and that the cover 30*c* may be attached to the headwear 10 using various different stitch configurations or other attachment mechanisms. For example, one embodiment of the present disclosure may not include the continuous stitches 34*a*, or the continuous stitches 34*a* may extend a different percentage of the lower edge 36*c* or upper edge 35*c*.

Figure 25:
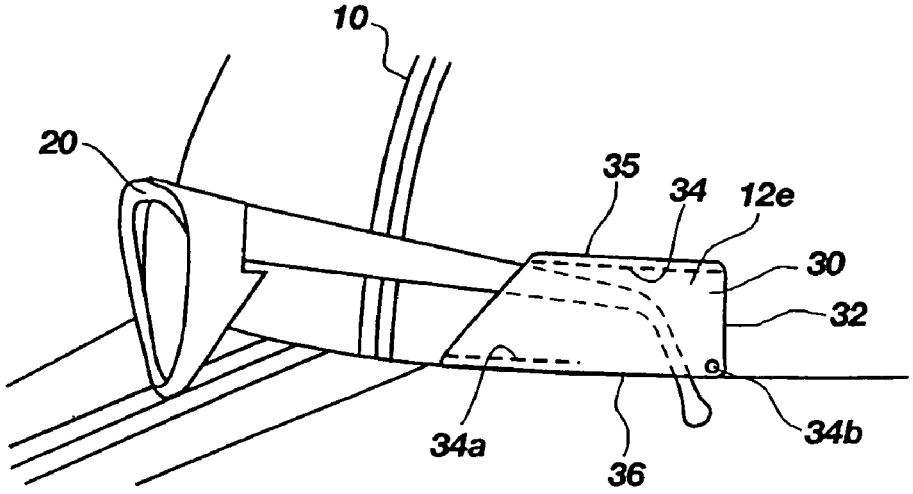
FIG. 25 is a break-away side view of an additional embodiment externally mounted utility holder assembly depicting a resulting storage position of an article.
Figure 26:
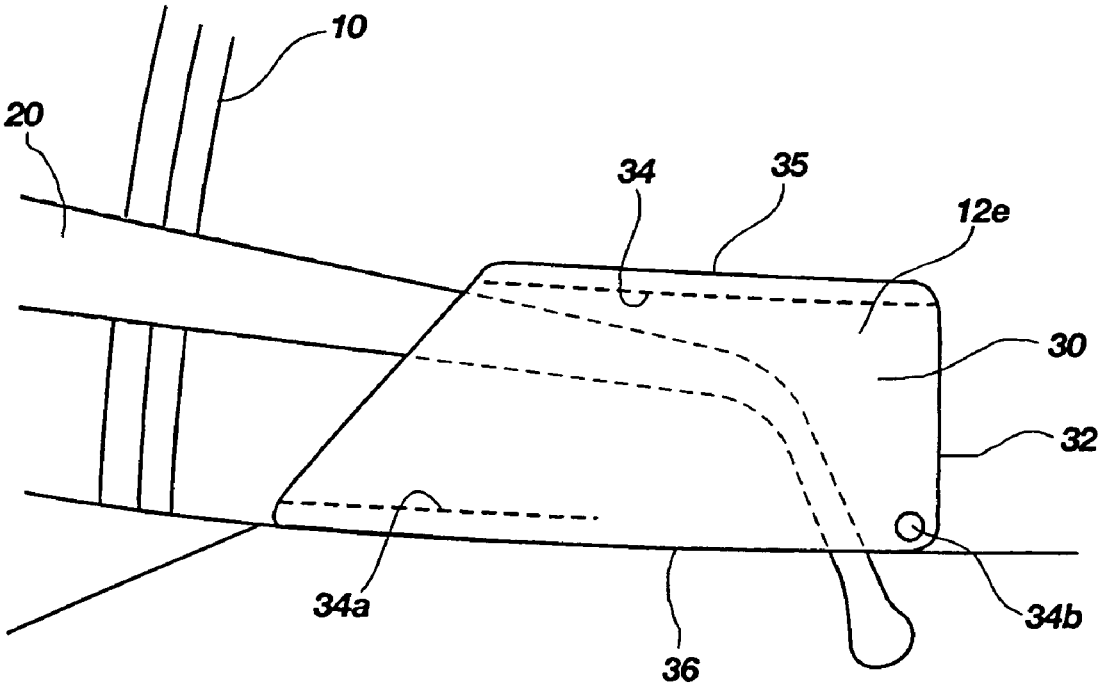
FIG. 26 is a break-away side view showing the externally mounted utility holder of FIG. 25 enlarged.
Figure 27:
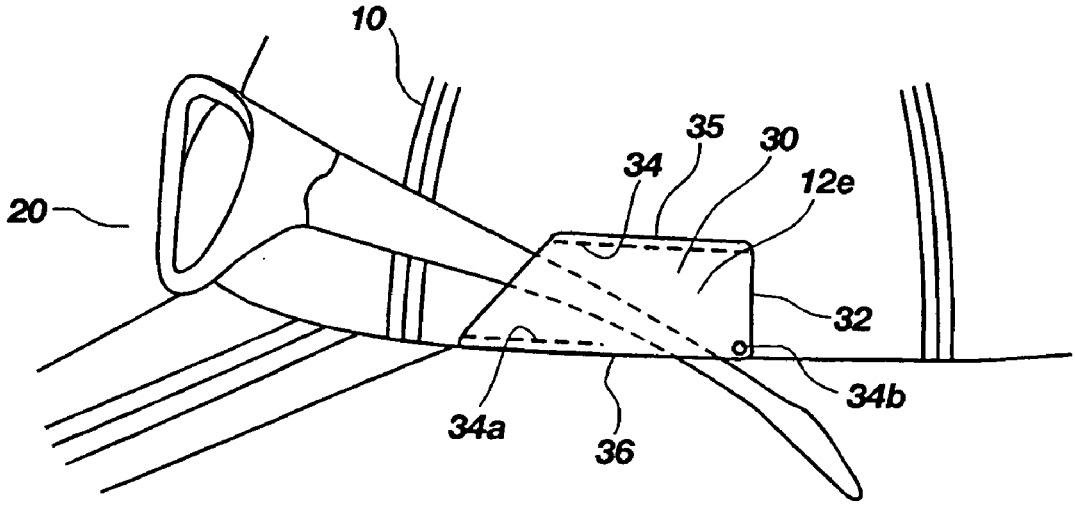
FIG. 27 is a break-away side view of the externally mounted utility holder assembly embodiment of FIG. 25, depicting a resulting storage position of an alternative embodiment article.
Figure 28:
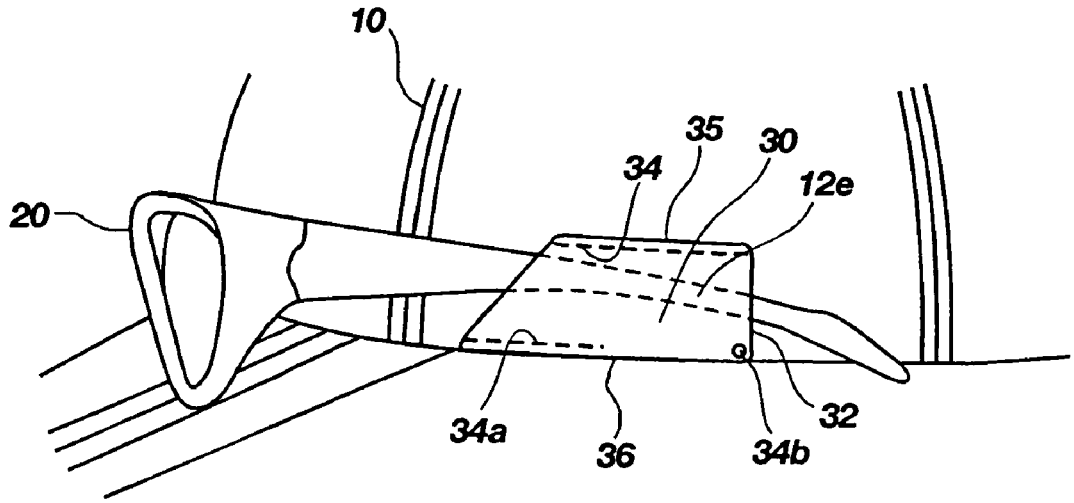
FIG. 28 is a break-away side view of the externally mounted utility holder assembly embodiment of FIG. 25, depicting an alternative storage position of an article.

As shown most clearly in FIGS. 25-28, the continuous stitches 34*a* and point stitches 34*b* may also be used to connect the cover 30 to the headwear 10 to create yet another embodiment of the holder, as indicated at 12*e*. Accordingly, the lower edge 36 may include an opening for allowing the article 20 to pass therethrough, as shown in FIGS. 25-27. Alternatively, the article 20 may be allowed to pass through the rear edge 32, as shown in FIG. 28. Accordingly, the holder 12*e* may be very versatile to accommodate articles 20 of various different configurations in various different positions.

Figure 29:
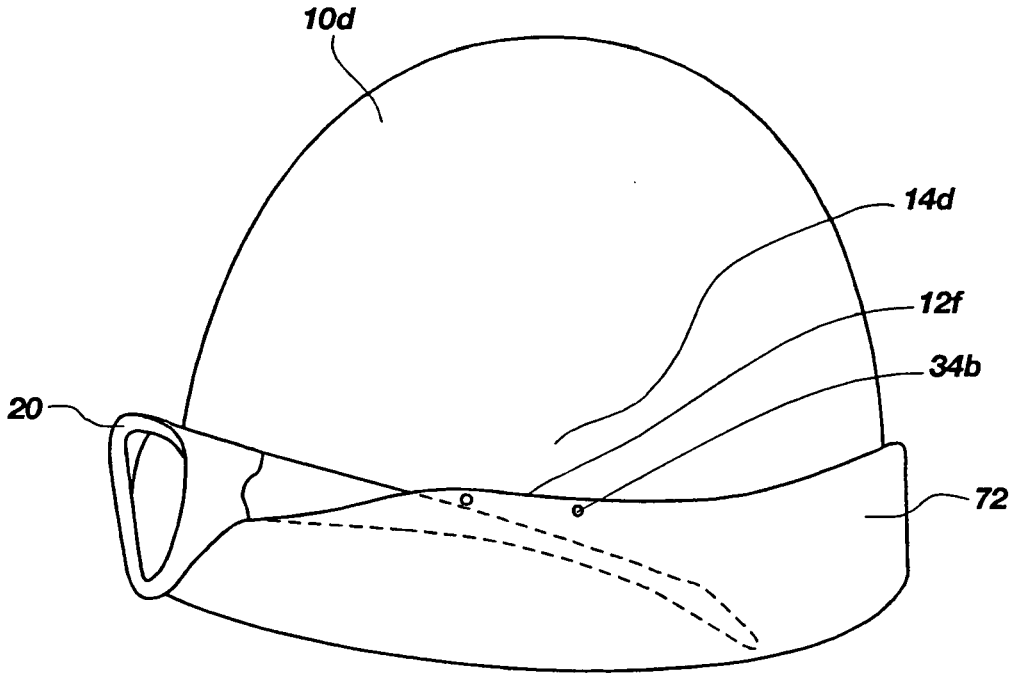
FIG. 29 is a side view of a further embodiment utility holder assembly depicting a resulting storage position of an article.
Figure 30:
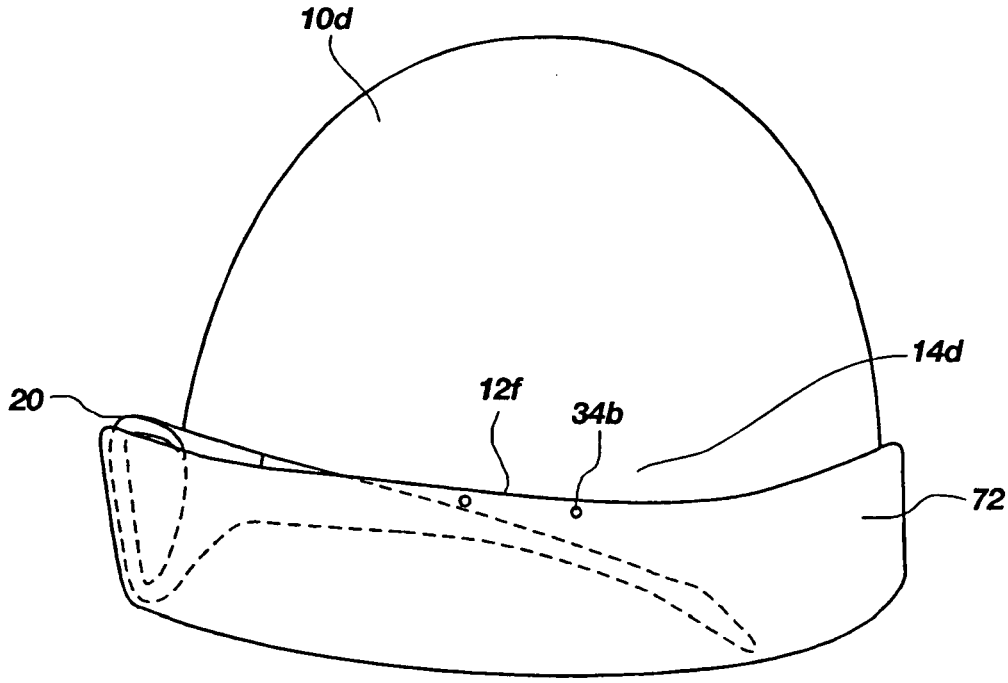
FIG. 30 is an enlarged break-away side view showing the utility holder of FIG. 29 and an alternative storage position of an article.
Figure 31:
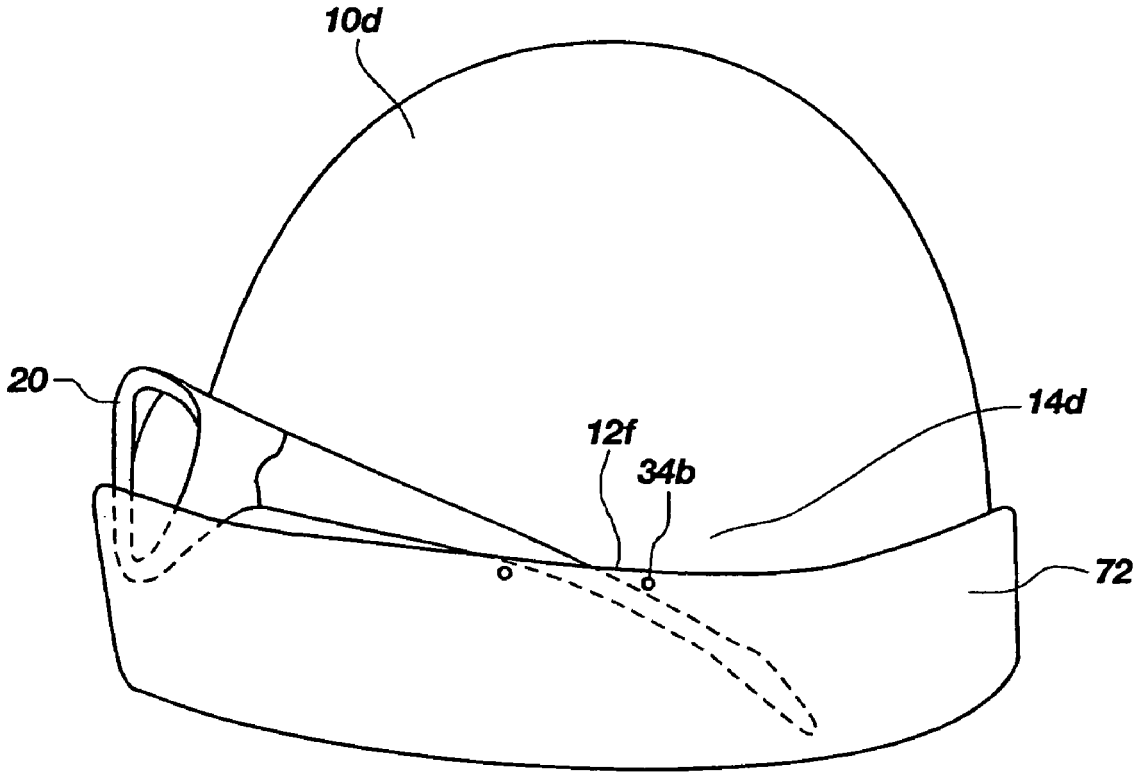
FIG. 31 is an enlarged break-away side view showing the utility holder of FIG. 29 and an additional alternative storage position of an article.

Referring now to FIGS. 29-31, yet another embodiment of the holder is shown, as indicated at 12*f*. The holder 12*f* may be particularly well suited for headwear 10*d* in the form of ski caps. It will be understood that the illustrative embodiment depicted in FIGS. 29-31 contains many of the same features as the embodiments discussed above, and only the pertinent different features will be discussed herein to more succinctly describe the characteristics of the embodiment of the disclosure depicted in FIGS. 29-31.

Point stitches 34*b* may be used to attach a rim portion 72 of the headwear 10*d* to an exterior surface 14*d* of the headwear 10*d*. For example, in one embodiment, a pair of point stitches 34*b*, or other attaching mechanisms, may be attached to the rim portion 72 such that the holder 12*f* may be defined between the rim portion 72, the exterior surface 14*d* of the headwear 10*d*, and the point stitches 34*b*. Accordingly, the article 20 may be held to the headwear 10*d* in various different positions. For example, the article 20 may be held to be partially outside the rim portion 72 and partially between the rim portion 72 and the exterior surface 14*d* of the headwear 10*d* below the point stitches 34*b*, as shown most clearly in FIG. 29. Alternatively, the article 20 may be substantially completely held between the rim portion 72 and the exterior surface of the headwear 10*d*, as best shown in FIG. 30. The point stitches 34*b* may thereby be positioned above the article 20 to maintain the article 20 in position on the headwear 10*d*. Also, as shown most clearly in FIG. 31, the article 20 may be positioned between the point stitches 34*b* to extend partially outside the holder 12*f*.

It will be understood that point stitches 34*b* may be positioned in various different locations, and various different quantities of point stitches 34*b* may be used to provide holders 12*f* in a desired configuration. For example, three point stitches 34*b* may be provided to create a triangular holder 12*f*, or four point stitches 34*b* may be used to create a polygonal holder 12*f*. It will also be understood that the term "point stitch" as used herein shall be construed to include stitches that cover an area, which may appear as a point from a distance, such that the point stitch may not include an entire dimension of the object being stitched. Accordingly, point stitches may include multiple stitches, or strands in various different shapes, such that point stitches are not limited to a single stitch. Similarly, other attaching mechanisms known in the art may be used as an alternative to stitches.

It will be understood that any number of holders 12 may be used on the headwear 10, and that each of the holders 12 may be substantially identical, or each of the holders 12 may comprise different features as described above. Moreover, it will be understood that the features of the present disclosure may be manufactured using techniques known to those skilled in the art.

It will be appreciated that the structure and apparatus disclosed herein is merely one example of a means for gripping an article, and it should be appreciated that any structure, apparatus or system for gripping an article which performs functions the same as, or equivalent to, those disclosed herein are intended to fall within the scope of a means for gripping an article, including those structures, apparatus or systems for gripping articles which are presently known, or which may become available in the future. Anything which functions the same as, or equivalently to, a means for gripping and article falls within the scope of this element.

In accordance with the features and combinations described above, a useful method of holding an article on headwear includes the steps of:

(a) joining a holder to the headwear;

(b) placing the article in the holder;

(c) deforming a portion of the holder to correspond to the configuration of the article, such as by pressing the holder.

Those having ordinary skill in the relevant art will appreciate the advantages provide by the features of the present disclosure. For example, it is a feature of the present disclosure to provide an apparatus for holding an article to headwear which is simple in design and manufacture. Another feature of the present disclosure is to provide such an apparatus which is versatile for use with various different types of articles and various different types of headwear. It is a further feature of the present disclosure, in accordance with one aspect thereof, to provide an apparatus which is capable of enhanced gripping of the article to more securely hold the article to the headwear. It is an additional feature of the present disclosure to provide an apparatus for holding an article to headwear which has an aesthetically pleasing appearance. Those skilled in the pertinent arts will particularly appreciate the advantages which accrue with the provision of the enhanced gripping of the articles discussed in the present disclosure.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An apparatus for securing an article to a user's head, said apparatus comprising:

a headwear member for attaching to said user's head;

a holder disposed on said headwear member for receiving said article therein, said holder comprising an entrance to an interior surface of said holder, said holder further comprising a lower edge;

a ductile sheet member disposed on said interior surface of said holder for gripping said article;

wherein said entrance is disposed at an angle within a range of between approximately 45 to approximately 75 degrees with respect to said lower edge; and wherein said holder comprises a substantially triangular shape.

2. The apparatus of claim 1, wherein said entrance is disposed at an angle of approximately 60 degrees with respect to said lower edge of said holder.

3. The apparatus of claim 1, wherein said holder is configured to receive an article comprising at least one of an eyewear, tools, and writing utensils.

4. The apparatus of claim 1, further comprising at least one point stitch attaching said holder to said headwear.

5. The apparatus of claim 1, wherein said substantially triangular shape comprises three corners, wherein said holder is attached to said headwear with a point stitch at each of the corners and continuous stitching along at least a portion of said lower edge.

6. An apparatus for securing an article to a user's head, said apparatus comprising:

a headwear member for attaching to said user's head;

a holder disposed on said headwear member for receiving said article therein, said holder comprising an entrance to an interior surface of said holder, said holder further comprising a lower edge;

a ductile member disposed adjacent said entrance, said ductile member being configured to allow said article to be received in said holder and for deforming to assist in holding said article within said holder;

wherein said entrance is disposed at an angle within a range of between approximately 45 to approximately 75 degrees with respect to said lower edge; and wherein said holder comprises a substantially triangular shape.

7. The apparatus of claim 6, wherein said ductile member extends along at least a portion of an upper edge of said holder and along at least a portion of said lower edge of said holder.

8. The apparatus of claim 6, wherein said ductile member comprises a metal wire.

9. An apparatus for securing an article to a user's head, said apparatus comprising:

a headwear member for attaching to said user's head;

a holder disposed on said headwear member for receiving said article therein, said holder comprising an entrance to an interior surface of said holder, said holder further comprising a lower edge;

said holder comprising a substantially triangular shape having three corners, wherein said holder is attached to said headwear with a point stitch at each of the corners and continuous stitching along at least a portion of said lower edge; and wherein said entrance is disposed at an angle within a range of between approximately 45 to approximately 75 degrees with respect to said lower edge.

10. An apparatus for securing an article to a user's head, said apparatus comprising:

a headwear member for attaching to said user's head;

a holder disposed on said headwear member for receiving said article therein, said holder comprising an entrance to an interior surface of said holder, said holder further comprising a lower edge;

a ductile sheet member disposed on said interior surface of said holder for gripping said article;

wherein said holder comprises a polygonal shape having a plurality of corners, wherein said plurality of corners are attached to said headwear member, wherein at least a portion of said lower edge is attached to said headwear member and a remainder of said lower edge defines an opening to said interior surface of said holder; and wherein said holder comprises a substantially triangular shape.

11. An apparatus for securing an article to a user's head, said apparatus comprising:

a headwear member for attaching to said user's head;

a holder disposed on said headwear member for receiving said article therein, said holder comprising an entrance to an interior surface of said holder, said holder further comprising a lower edge;

a foam rubber piece disposed on said interior surface of said holder for gripping said article;

wherein said holder comprises a polygonal shape having a plurality of corners, wherein said plurality of corners are attached to said headwear member, wherein at least a portion of said lower edge is attached to said headwear member and a remainder of said lower edge defines an opening to said interior surface of said holder; and wherein said holder comprises a substantially triangular shape.

12. An apparatus for securing an article to a user's head, said apparatus comprising:

a headwear member for attaching to said user's head;

a holder disposed on said headwear member for receiving said article therein, said holder comprising an entrance to an interior surface of said holder, said holder further comprising a lower edge;

a ductile member disposed adjacent said entrance, said ductile member being configured to allow said article to be received in said holder and for deforming to assist in holding said article within said holder;

wherein said holder comprises a polygonal shape having a plurality of corners, wherein said plurality of corners are attached to said headwear member, wherein at least a portion of said lower edge is attached to said headwear member and a remainder of said lower edge defines an opening to said interior surface of said holder; and wherein said holder comprises a substantially triangular shape.

13. An apparatus for securing an article to a user's head, said apparatus comprising:

a headwear member for attaching to said user's head;

a holder disposed on said headwear member for receiving said article therein, said holder comprising an entrance to an interior surface of said holder, said holder further comprising a lower edge;

wherein said entrance is disposed at an angle within a range of between approximately 45 to approximately 75 degrees with respect to said lower edge; and wherein said holder comprises a substantial triangular shape and gripping means disposed on said interior surface of said holder for gripping said article, wherein said gripping means comprises a ductile member disposed adjacent said entrance, said ductile member being configured to allow said article to be received in said holder and for deforming to assist in holding said article within said holder.

14. The apparatus of claim 13, wherein said entrance is disposed at an angle of approximately 60 degrees with respect to said lower edge of said holder.

15. The apparatus of claim 13, wherein said holder is configured to receive an article comprising at least one of an eyewear, tools, and writing utensils.

16. The apparatus of claim 13, further comprising at least one point stitch attaching said holder to said headwear.

17. The apparatus of claim 13, wherein said substantially triangular shape comprises three corners, wherein said holder is attached to said headwear with a point stitch at each of the corners and continuous stitching along at least a portion of said lower edge.

* * * * *